US011737588B2

(12) United States Patent
Mertz, II et al.

(10) Patent No.: US 11,737,588 B2
(45) Date of Patent: Aug. 29, 2023

(54) SNACK PALLET ASSEMBLY

(71) Applicant: Menasha Corporation, Neenah, WI (US)

(72) Inventors: William J. Mertz, II, Greensburg, PA (US); Brad L. Clark, North Huntingdon, PA (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 17/846,472

(22) Filed: Jun. 22, 2022

(65) Prior Publication Data

US 2022/0386792 A1 Dec. 8, 2022

Related U.S. Application Data

(63) Continuation of application No. 16/994,836, filed on Aug. 17, 2020, now Pat. No. 11,395,552, which is a continuation of application No. 16/166,372, filed on Oct. 22, 2018, now Pat. No. 10,772,442.

(60) Provisional application No. 62/576,922, filed on Oct. 25, 2017.

(51) Int. Cl.

| | |
|---|---|
| ***A47F 5/11*** | (2006.01) |
| ***B65D 19/44*** | (2006.01) |
| ***B65D 71/00*** | (2006.01) |
| ***A47B 87/02*** | (2006.01) |

(52) U.S. Cl.

CPC ..... *A47F 5/114* (2013.01); *A47F 5/116* (2013.01); *A47F 5/118* (2013.01); *B65D 19/44* (2013.01); *B65D 71/0096* (2013.01); *A47B 87/0246* (2013.01); *B65D 2519/00815* (2013.01); *B65D 2571/00055* (2013.01)

(58) Field of Classification Search

CPC ..... A47F 5/114; A47F 5/116; A47F 5/118; B65D 19/44; B65D 71/0096; B65D 2519/00815; B65D 2571/00055; A47B 87/0246

See application file for complete search history.

(56) References Cited

U.S. PATENT DOCUMENTS

| | | | |
|---|---|---|---|
| 2,475,107 | A | 7/1949 | Newsom |
| 3,055,573 | A | 9/1962 | Carter |
| 3,283,989 | A | 11/1966 | De Paul |
| 3,404,804 | A | 10/1968 | Frater et al. |
| 3,420,402 | A | 1/1969 | Frater et al. |
| 3,957,196 | A | 5/1976 | Kellerman |
| 4,209,125 | A | 6/1980 | Helms |
| 4,282,999 | A | 8/1981 | Moen |

(Continued)

FOREIGN PATENT DOCUMENTS

| | | | |
|---|---|---|---|
| CA | 3021993 | A1 | 4/2019 |
| CA | 3021993 | C | 4/2022 |

*Primary Examiner* — Anita M King

(74) *Attorney, Agent, or Firm* — GREENSFELDER, HEMKER & GALE, P.C.; Richard C. Himelhoch

(57) ABSTRACT

A pallet assembly including a plurality of trays separated by supports is provided. Each of the supports includes a rectangular portion and a wing portion. The wing portion is formed from two layers of materials connected together by a locking tab or other suitable means. The wing portion can include a first portion and a second portion at an angle with respect to the first portion. A tab can be used to facilitate placing the first portion of the wing at the angle with respect to the second portion of the wing.

20 Claims, 14 Drawing Sheets

(56) References Cited

U.S. PATENT DOCUMENTS

| | | | | |
|---|---|---|---|---|
| 4,330,078 | A | 5/1982 | Graser | |
| 4,372,444 | A | 2/1983 | Le Grand et al. | |
| 4,605,158 | A | 8/1986 | Barton | |
| 4,858,774 | A | 8/1989 | Winter et al. | |
| 5,839,650 | A | 11/1998 | Sheffer | |
| 5,947,292 | A | 9/1999 | Chelfi | |
| 5,992,735 | A | 11/1999 | Oosterbaan | |
| 6,029,886 | A | 2/2000 | Sheffer | |
| 6,098,821 | A | 8/2000 | Cube et al. | |
| 6,378,764 | B1 | 4/2002 | Teixidor Casanovas | |
| 6,513,705 | B1 * | 2/2003 | Sheffer | B65D 5/4204 229/187 |
| 6,868,968 | B1 | 3/2005 | Casanovas | |
| 7,066,342 | B2 | 6/2006 | Baechle et al. | |
| 7,118,023 | B2 | 10/2006 | Holdsworth | |
| 7,637,372 | B2 * | 12/2009 | Keel | B65D 5/4204 206/509 |
| 7,823,725 | B1 | 11/2010 | Shupe | |
| 8,317,039 | B2 | 11/2012 | Norman | |
| 8,567,661 | B2 | 10/2013 | Sullivan et al. | |
| 8,833,573 | B2 | 9/2014 | Tomaszewski et al. | |
| 9,138,079 | B2 | 9/2015 | Su | |
| 9,428,298 | B2 * | 8/2016 | Bersamin | B65D 5/006 |
| 9,566,756 | B2 | 2/2017 | Brundage | |
| 9,580,201 | B2 | 2/2017 | Willman et al. | |
| 9,655,446 | B2 * | 5/2017 | Brady | A47B 55/06 |
| 9,783,333 | B1 | 10/2017 | De Los Santos et al. | |
| 9,826,843 | B1 * | 11/2017 | Tomaszewski | B65D 5/5035 |
| 9,926,100 | B2 | 3/2018 | Adams | |
| 9,918,569 | B1 | 8/2018 | Abel | |
| 10,315,798 | B2 | 6/2019 | Pfeifer et al. | |
| 10,745,171 | B2 | 8/2020 | Pfeifer et al. | |
| 10,772,442 | B2 | 9/2020 | Mertz, II et al. | |
| 11,267,609 | B2 | 3/2022 | Pfeifer et al. | |
| 11,395,552 | B2 | 7/2022 | Mertz, II et al. | |
| 2006/0108408 | A1 | 5/2006 | Lowry | |
| 2006/0249565 | A1 * | 11/2006 | Wood | B65D 5/002 229/164 |
| 2009/0032432 | A1 | 2/2009 | Kostos et al. | |
| 2010/0084459 | A1 | 4/2010 | Little | |
| 2013/0180941 | A1 | 7/2013 | Tomaszewski | |
| 2015/0076096 | A1 | 3/2015 | Brady et al. | |
| 2015/0122690 | A1 | 5/2015 | Bersamin et al. | |
| 2016/0272360 | A1 | 9/2016 | Adams | |
| 2016/0368660 | A1 | 12/2016 | Pfeifer et al. | |
| 2017/0152072 | A1 | 6/2017 | Brundage | |
| 2018/0092461 | A1 | 4/2018 | Brady et al. | |
| 2018/0160825 | A1 | 6/2018 | Abel | |
| 2018/0170608 | A1 | 6/2018 | Adams | |
| 2019/0021521 | A1 | 1/2019 | Kula | |
| 2019/0256249 | A1 | 8/2019 | Pfeifer et al. | |
| 2020/0024032 | A1 | 1/2020 | Urban et al. | |
| 2020/0385170 | A1 | 12/2020 | Pfeifer et al. | |

* cited by examiner

SNACK PALLET ASSEMBLY

CROSS-REFERENCE TO RELATED APPLICATIONS

The present invention is a continuation of U.S. patent application Ser. No. 16/994,836 filed Aug. 17, 2020, which is a continuation of U.S. patent application Ser. No. 16/166,372 filed Oct. 22, 2018, now U.S. Pat. No. 10,772,442, which claims priority to and the benefit of U.S. Provisional Patent Application No. 62/576,922 filed Oct. 25, 2017, the contents of which are incorporated herein by reference.

FEDERALLY SPONSORED RESEARCH OR DEVELOPMENT

N/A

FIELD OF THE INVENTION

The present invention is generally directed toward displays for goods, such as chips and other snack food, in a store.

DESCRIPTION OF THE PRIOR ART

There are a large variety of systems for transporting and/or displaying goods like chips and other snack foods in a store. Such systems need to be lightweight and easy to assemble.

The present invention provides an easy to construct pallet assembly for displaying goods.

SUMMARY OF THE INVENTION

The present invention is directed to a pallet assembly having a plurality of trays separated by supports. The supports include dividers for separating (or at least partially separating) goods on the pallet assembly.

In accordance with one aspect of the invention a pallet assembly is provided comprising a first tray having a rectangular support surface and a first support. The first support is connected to a first corner of the first tray and extends upward therefrom. The first support has a rectangular corner portion (i.e., in cross-section) and a wing portion. The wing portion of the first support includes a first layer of material and a second layer of material connected to the first layer of material. The wing portion acts as a divider for a portion of the tray support surface to separate goods in that area of the tray.

The assembly further includes a second support connected to a second corner of the first tray and extending upward therefrom. The second support having a rectangular corner portion and a wing portion. The wing portion of the second support including a first layer of material and a second layer of material connected to the first layer of material. The assembly also includes a third support connected to a third corner of the first tray and extending upward therefrom, the third support having a rectangular corner portion and a wing portion. The wing portion of the third support including a first layer of material and a second layer of material connected to the first layer of material. The assembly further includes a fourth support connected to a fourth corner of the first tray and extending upward therefrom. The fourth support having a rectangular corner portion and a wing portion.

The wing portion of the fourth support including a first layer of material and a second layer of material connected to the first layer of material.

The supports can include a plurality of tabs extending downward from a lower edge of the support. The support surface of the tray can include a plurality of slots configured to receive the plurality of tabs in the supports.

The first layer of material in the wing portion can be connected to the second layer of material in the wing portion by a first locking tab. Additional locking tabs can be added as necessary. The wing portion can also include a positioning tab for securing a first portion of the wing portion at an angle (e.g., a right angle) with respect to a second portion of the wing portion.

The tray can include a first side wall along a first side, a second side wall along a second side, a third side wall along a third side and a fourth side wall along a fourth side. The side walls can be formed from a plurality of panels folded over. A top edge of the panels can be formed from a double scored portion. The double scored portion can include two non-parallel, slightly arcuate scores.

The supports can include a first lower panel configured to contact an outer surface of a side wall and a second lower panel configured to contact an outer surface of a second side wall. Thus, each support will partially sit on (or span a) top of a corner formed by the side walls.

The supports can include an upper tab extending from a top portion of the rectangular portion of the first support. The support can also include a recess between the first lower panel and the second lower panel. The recess can be sized to mate with the upper tab of another support positioned below the first support (in an assembly with multiple layers of trays/supports).

A second tray can be connected to a top portion of each of the first support, second support, third support and fourth support extending upward from the first tray. Moreover, a first support can be connected to a first corner of the second tray and extend upward therefrom, a second support can be connected to a second corner of the second tray and extend upward therefrom, a third support can be connected to a third corner of the second tray and extending upward therefrom and a fourth support can be connected to a fourth corner of the second tray and extending upward therefrom. Each of the supports can include a rectangular corner portion and a wing portion. The wing portion in each support can include a first layer of material and a second layer of material connected to the first layer of material.

The assembly can include a third tray connected to a top portion of each of the first support, second support, third support and fourth support extending upward from the second tray. Similar to the first tray and the second tray, the third tray can include four supports, one in each corner of the tray. The supports can each include a rectangular corner portion and a wing portion, the wing portion including a first layer of material and a second layer of material connected to the first layer of material.

A top cap can be connected to a top portion of each of the first support, second support, third support and fourth support extending upward from the third tray. While one preferred assembly includes three trays and a top cap, other assemblies can include fewer or more trays and supports.

In accordance with another aspect of the invention, a pallet assembly comprising a plurality of trays forming a plurality of layers is provided. The assembly also includes a plurality of supports in each of the trays. Each support has a rectangular corner portion and a wing portion where the wing portion includes a first layer of material and a second layer of material connected to the first layer of material. The assembly can further comprise a top cap on an uppermost layer of supports.

The first layer of material in the wing portion of each of the plurality of supports is connected to the second layer of material in the wing portion of each of the plurality of supports by a first locking tab. Again, more locking tabs can be added as necessary.

Each of the plurality of trays can includes a first side wall along a first side, a second side wall along a second side, a third side wall along a third side and a fourth side wall along a fourth side.

Alternative supports can also be used. For example, the support can include an L-shaped section (in cross-section) connected to a wing portion or divider portion. The L-shaped portion can have a double wall thickness.

The trays, supports and top cap of either aspect can be formed from corrugated paper. These components can also be formed from other suitable materials, such as a plastic corrugated material.

Further aspects of the present invention are described herein and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
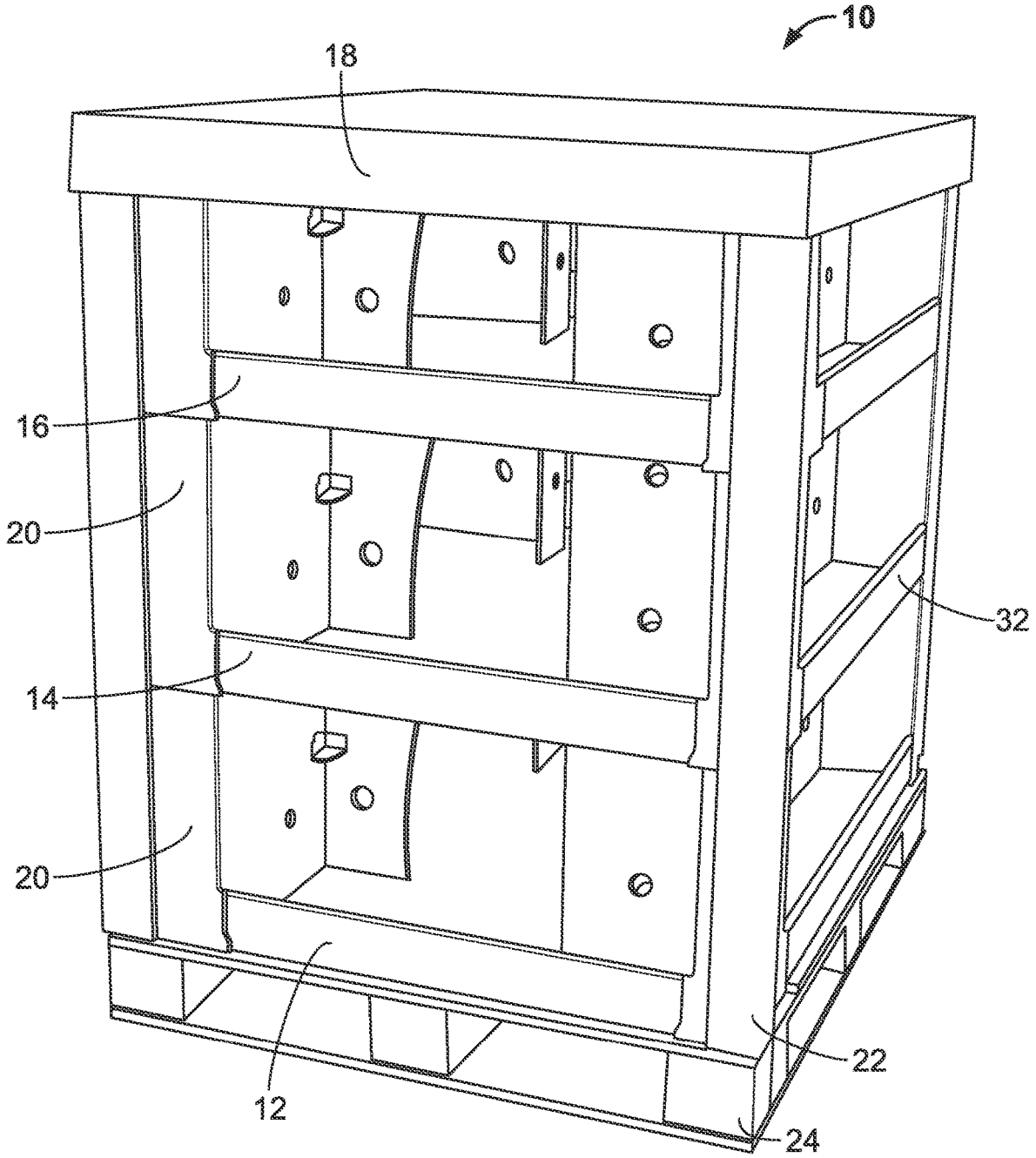
FIG. 1 is a perspective view of a pallet assembly in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A pallet assembly 10 in accordance with the present invention is shown fully assembled in FIG. 1. The pallet assembly 10 is preferably formed from a corrugated paper, a plastic corrugated material, or other similar materials. Graphical designs or other indicia or colors can be printed on the material. While the pallet assembly 10 of FIG. 1 shows the assembly having three levels, it can be made with more or fewer levels as desired for a particular purpose or space.

The pallet assembly 10 includes a lowermost tray 12, and two additional trays 14 and 16 to form three levels. A top cap 18 is on the upper most level 16. Each tray 12, 14, 16, includes four supports 20 that separate the levels of the pallet assembly 10. The supports 20 hold the trays and/or top cap above the supports and also include structure to partially create separate areas on the tray surface for display of goods. Four corner posts 22 are placed on the corners of each of the trays 12, 14, 16 and supports 20. Each corner post 22 extends the height of the pallet assembly 10.

The entire pallet assembly 10 can be transported on a wood pallet 24 as shown in FIG. 1. However, plastic pallets and other transport devices can alternatively be used to move the completed assembly 10.

FIGS. 2A, 2B, 3A, 3B and 5 show blanks for forming the trays, supports and top caps for the pallet assembly 10. In addition to the features evident in the blanks, other features of these components will be discussed with respect to setting up the assembly 10.

Figure 2A:
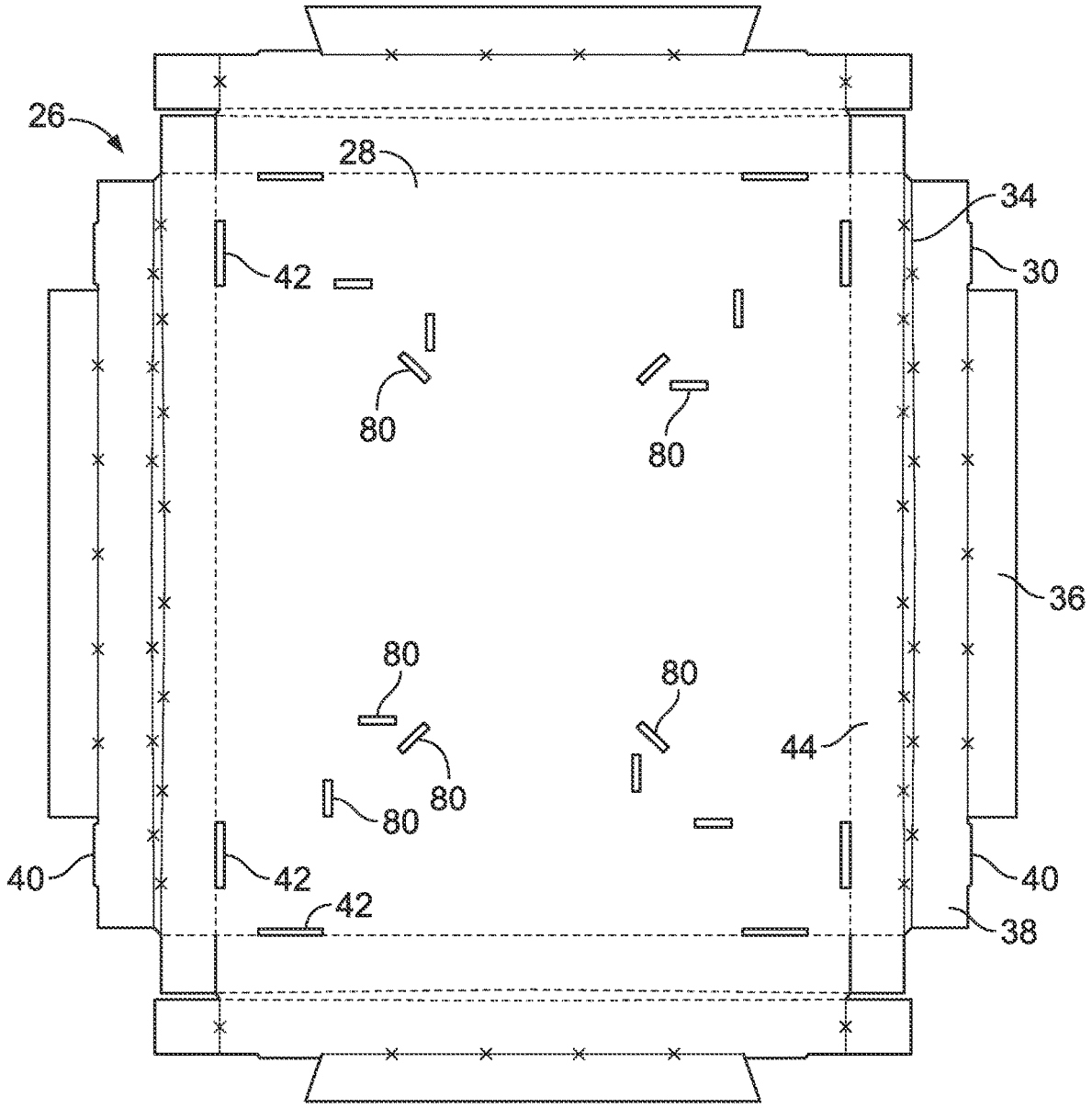
FIG. 2A is a top plan view of a first blank for forming a tray component of the pallet assembly of FIG. 1.
Figure 2B:
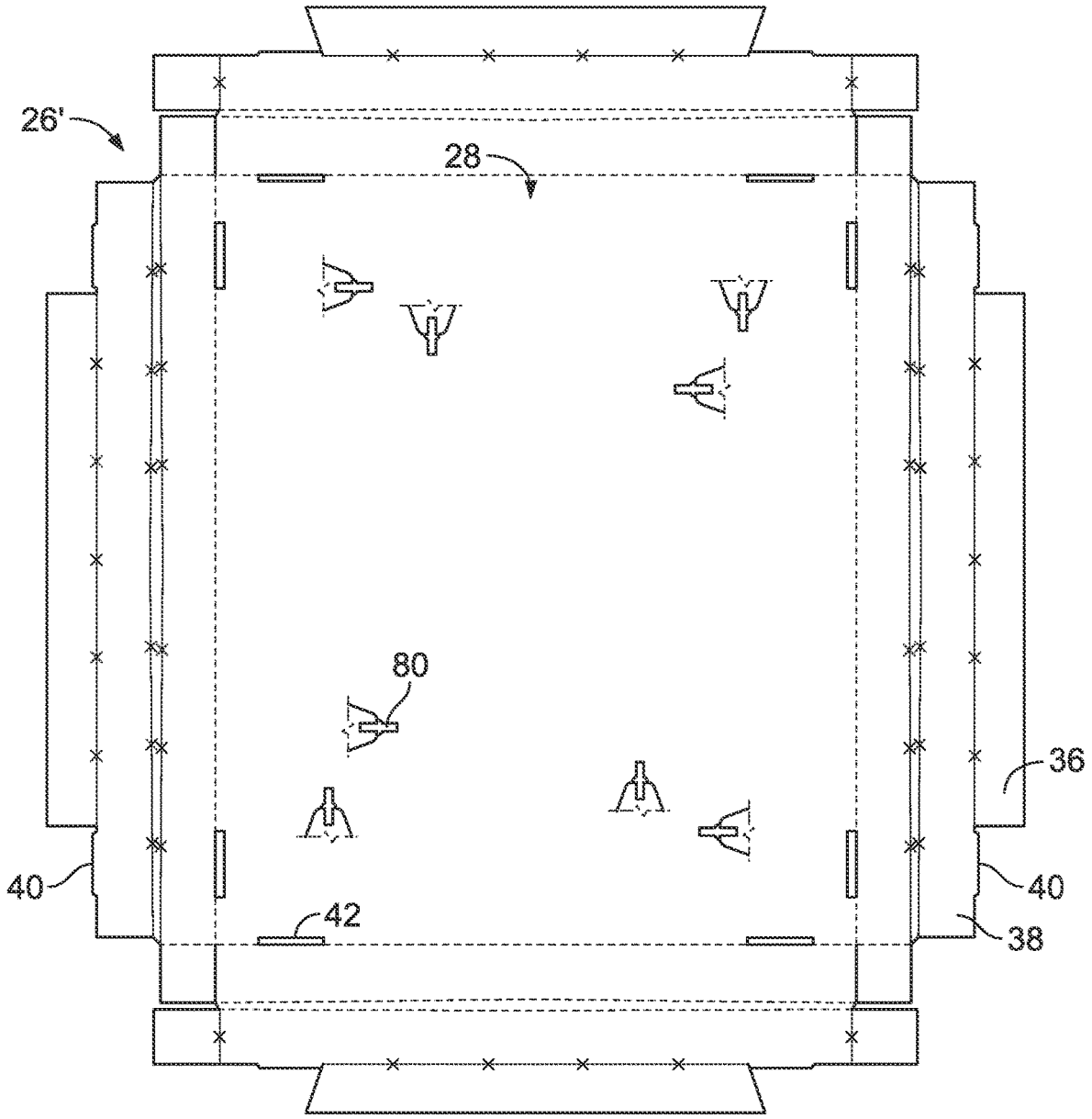
FIG. 2B is a top plan view of second blank for forming a tray component of the pallet assembly of FIG. 1.

Turning to FIGS. 2A and 2B, each figure shows a version of a blank 26, 26' for forming a tray 12, 14 or 16. The blank 26 includes a central, generally rectangular support surface or panel 28, and a plurality of foldable panels 30 along each side of the support panel 28 for forming side walls 32 for the tray. As evident by the dashed fold lines, the portion that ends up being a top edge of each side wall 32 has a double score 34. The lines forming the double score 34 are not quite straight or parallel. Instead, the dashed fold lines are each slightly curved and are wider apart toward the middle of the side wall 32. This configuration provides extra strength in the side wall 32.

Each foldable panel 30 includes an outermost panel 36 that is folded inward. An adjacent panel to the outermost panel 36, which when folded forms an inner wall panel 38 of the side wall 32, includes first and second tabs 40 that cooperate with first and second slots 42 in the support surface 28. An outer wall panel 44 is separated from the inner wall panel 38 by the double score 34.

Figure 3A:
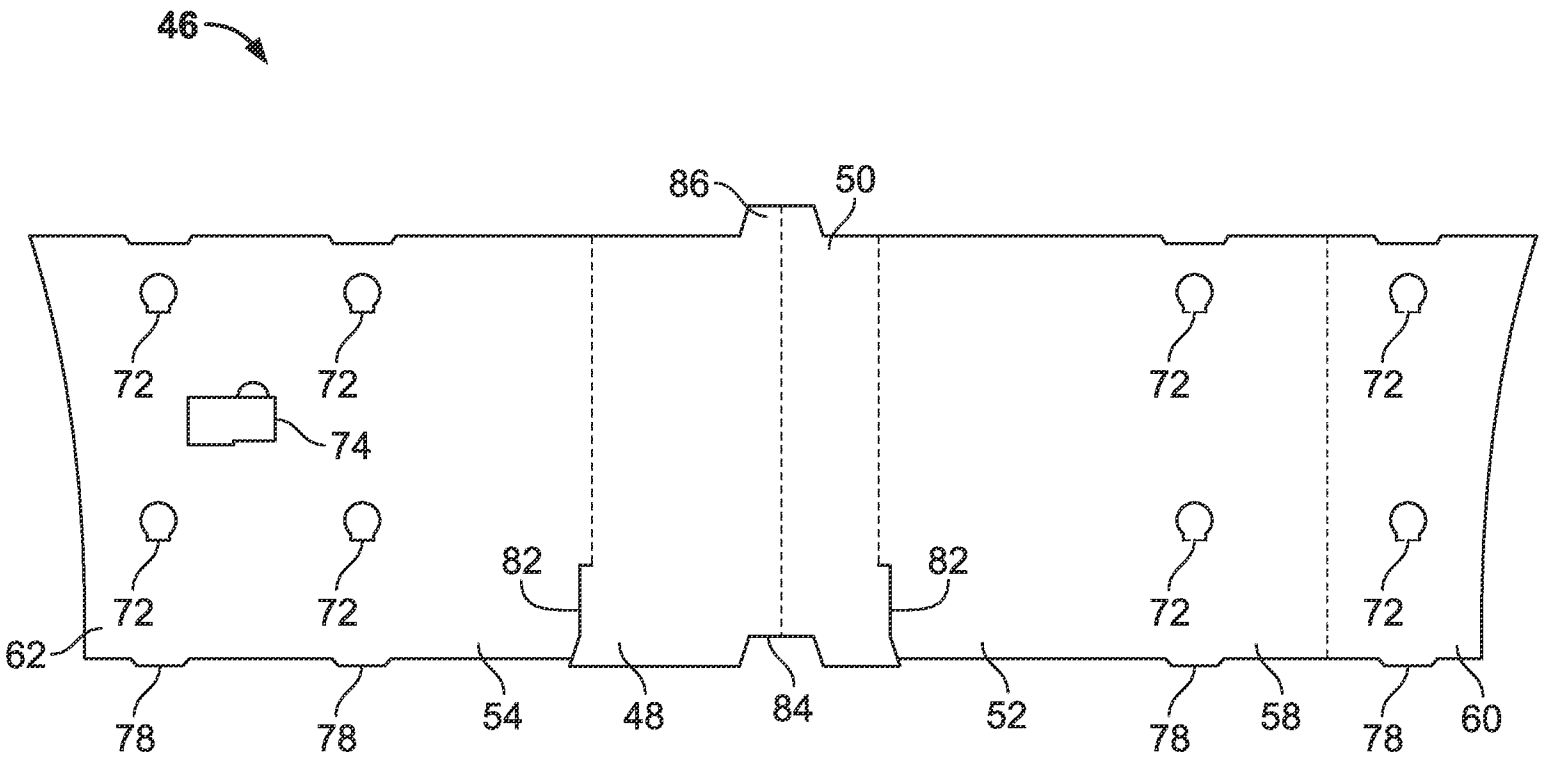
FIG. 3A is a top plan view of a first blank for forming a support component of the pallet assembly of FIG. 1.
Figure 3B:
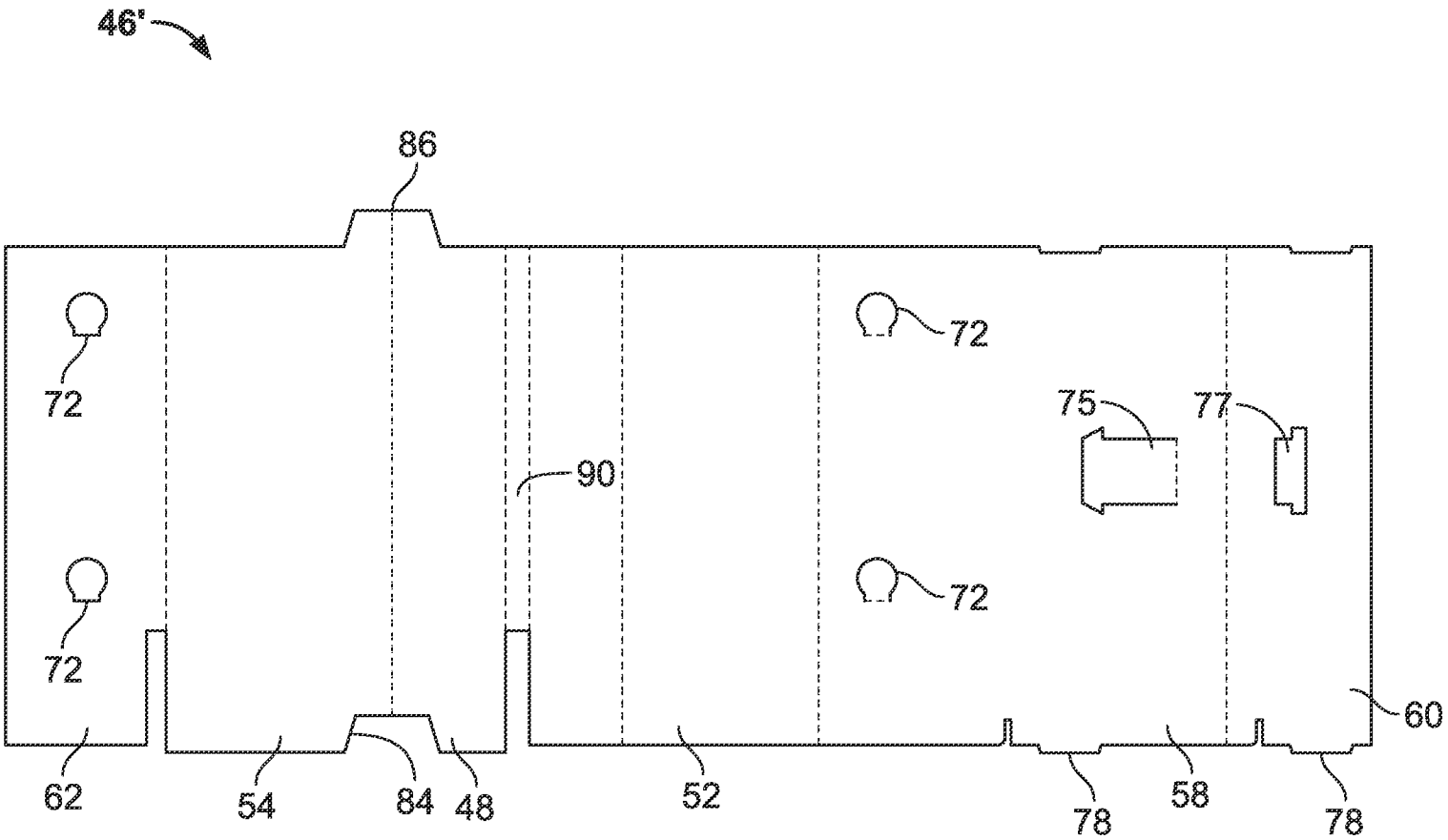
FIG. 3B is a top plan view of a second blank for forming a support component of the pallet assembly of FIG. 1.

FIGS. 3A and 3B each show a blank 46, 46' for forming a support 20. The blank 46 of FIG. 3A includes panels 48, 50 and 52 that cooperate with a portion of panel 54 to form a generally rectangular corner portion 56. The remainder of panel 54 and panels 58, 60 and 62 form a wing or divider portion 64 of the support 20.

Figure 4:
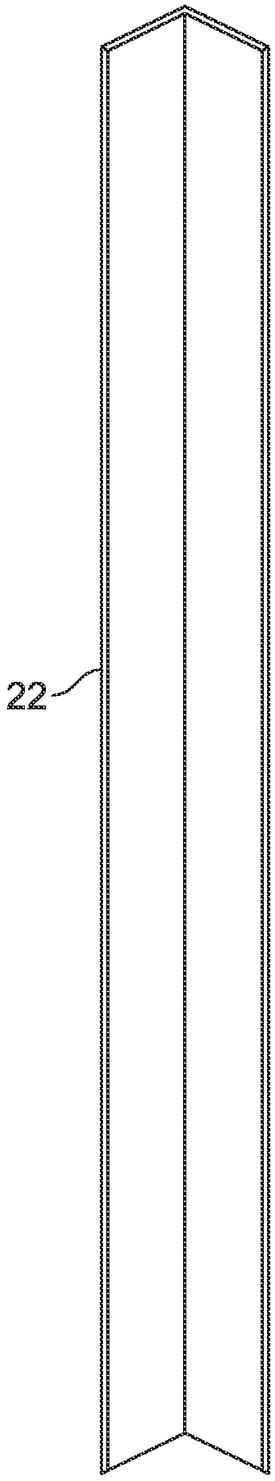
FIG. 4 is a perspective view of a corner post for use in the pallet assembly of FIG. 1.

A perspective view of the corner post 22 is shown in FIG. 4. The corner post 22 includes a first rectangular segment or strip and a second rectangular segment or strip perpendicular to the first strip. The post 22 is sized to extend the height of the completed pallet assembly 10.

Figure 5:
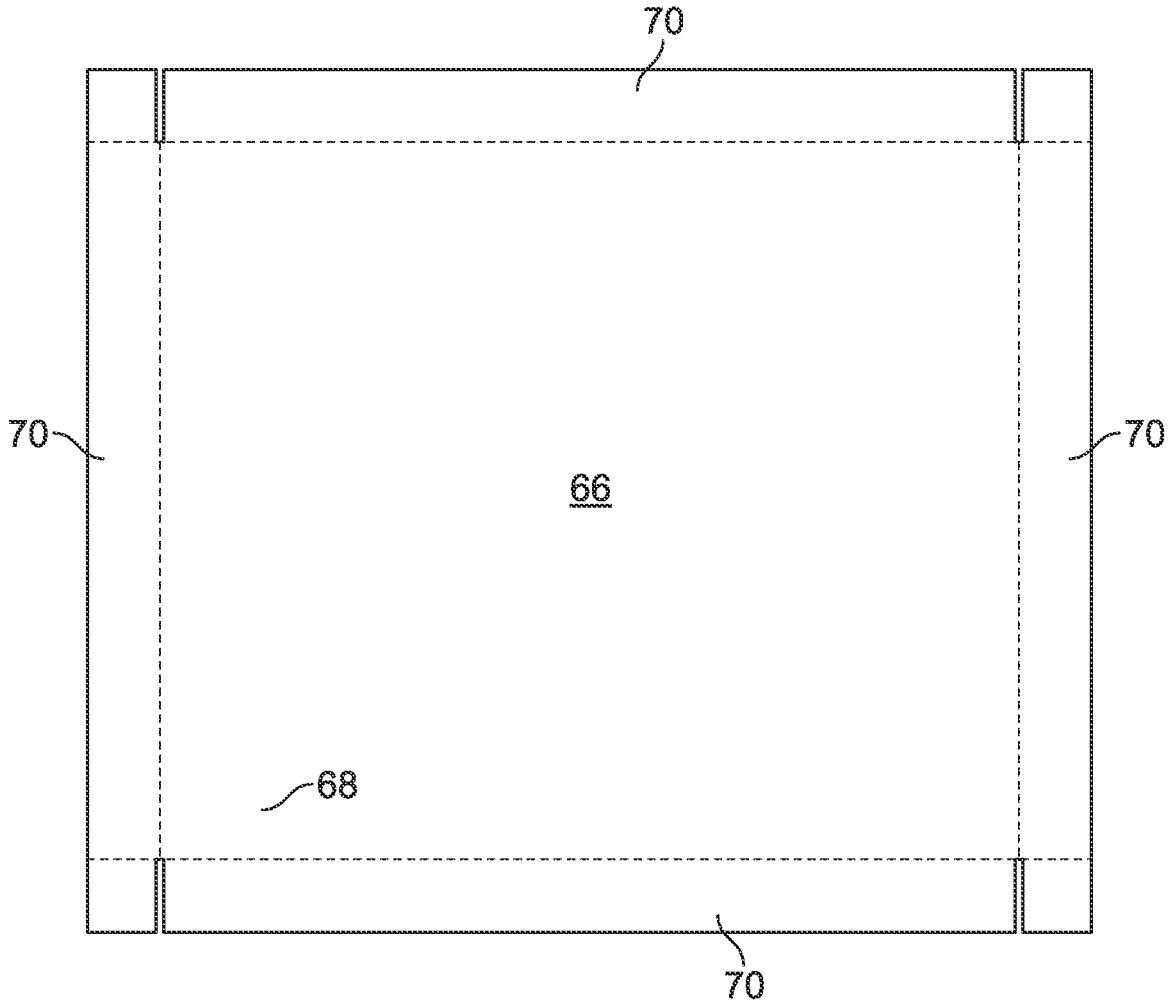
FIG. 5 is a top plan view of a blank for forming a top cap component of the pallet assembly of FIG. 1.

FIG. 5 shows a blank 66 for forming the top cap 18. The blank 66 includes a central, rectangular top portion 68 and four flaps 70 that can be folded to form downwardly extending side walls.

Figure 6:
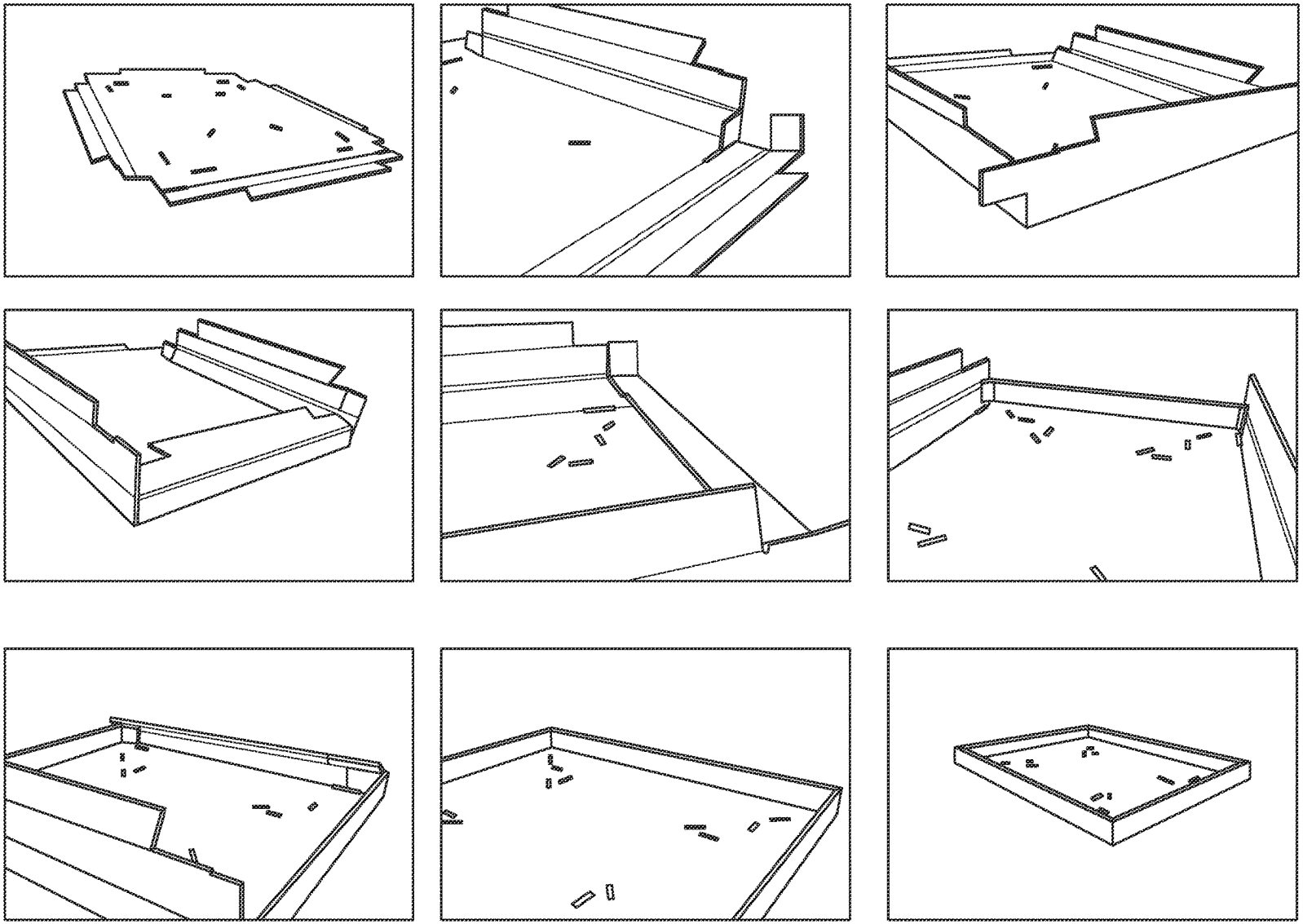
FIG. 6 is a series of perspective views illustrating forming of the tray component from the blank of FIG. 2A.

FIGS. 6-7, 8A-8B and 9A-9B illustrate steps for setting up the pallet assembly 10. FIG. 6 shows the blank 28 for the tray components 12, 14 and 16 being formed. The foldable panels 30 are folded over to form upwardly extending side walls for the tray. The outermost panel 36 is folded between the inner wall panel 38 and the outer wall panel 44. The double score 34 forms the upper edge of each side wall of the tray.

Figure 7:
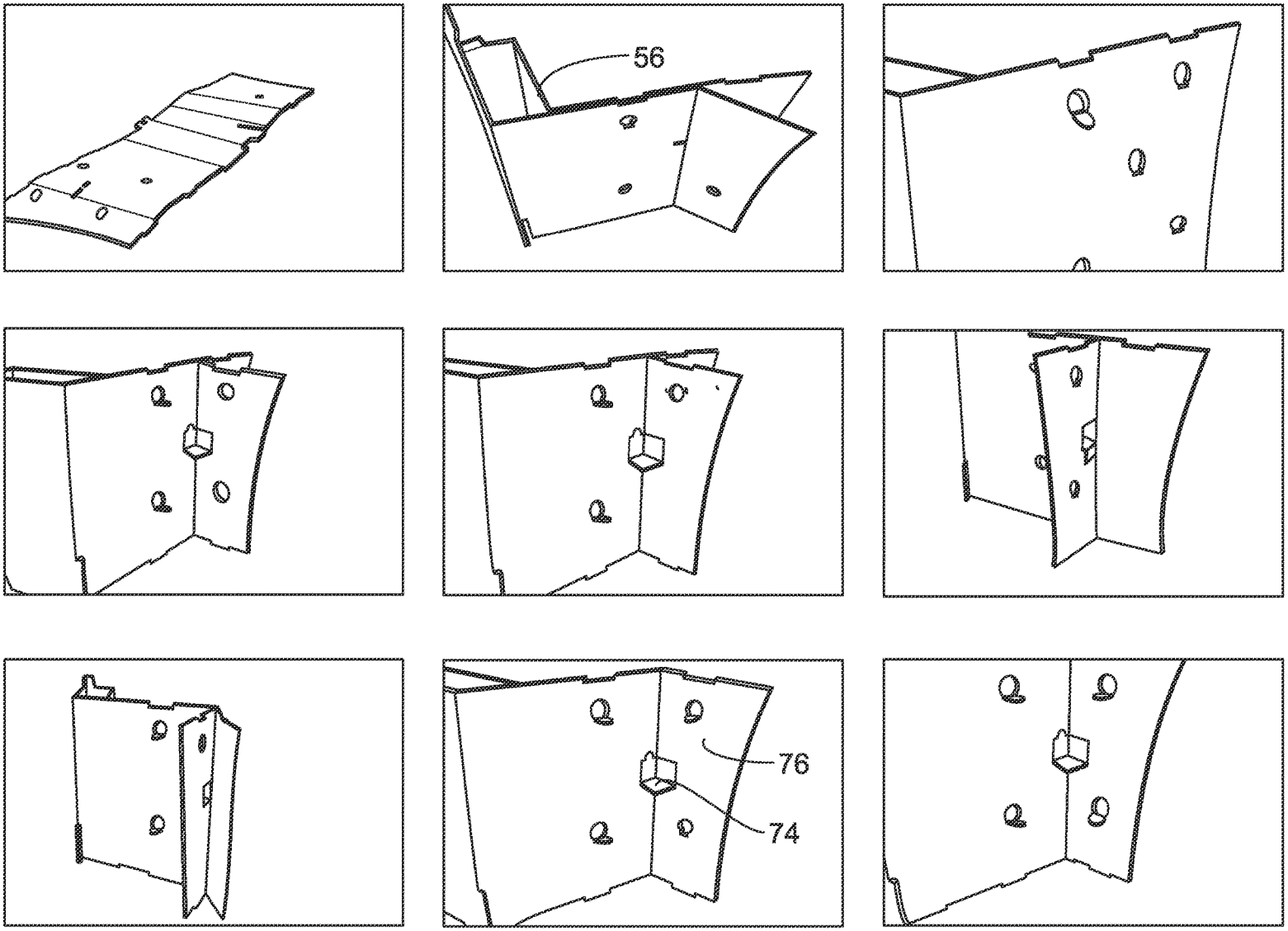
FIG. 7 is a series of perspective views illustrating forming of the support component from the blank of FIG. 3A.
Figure 8A:
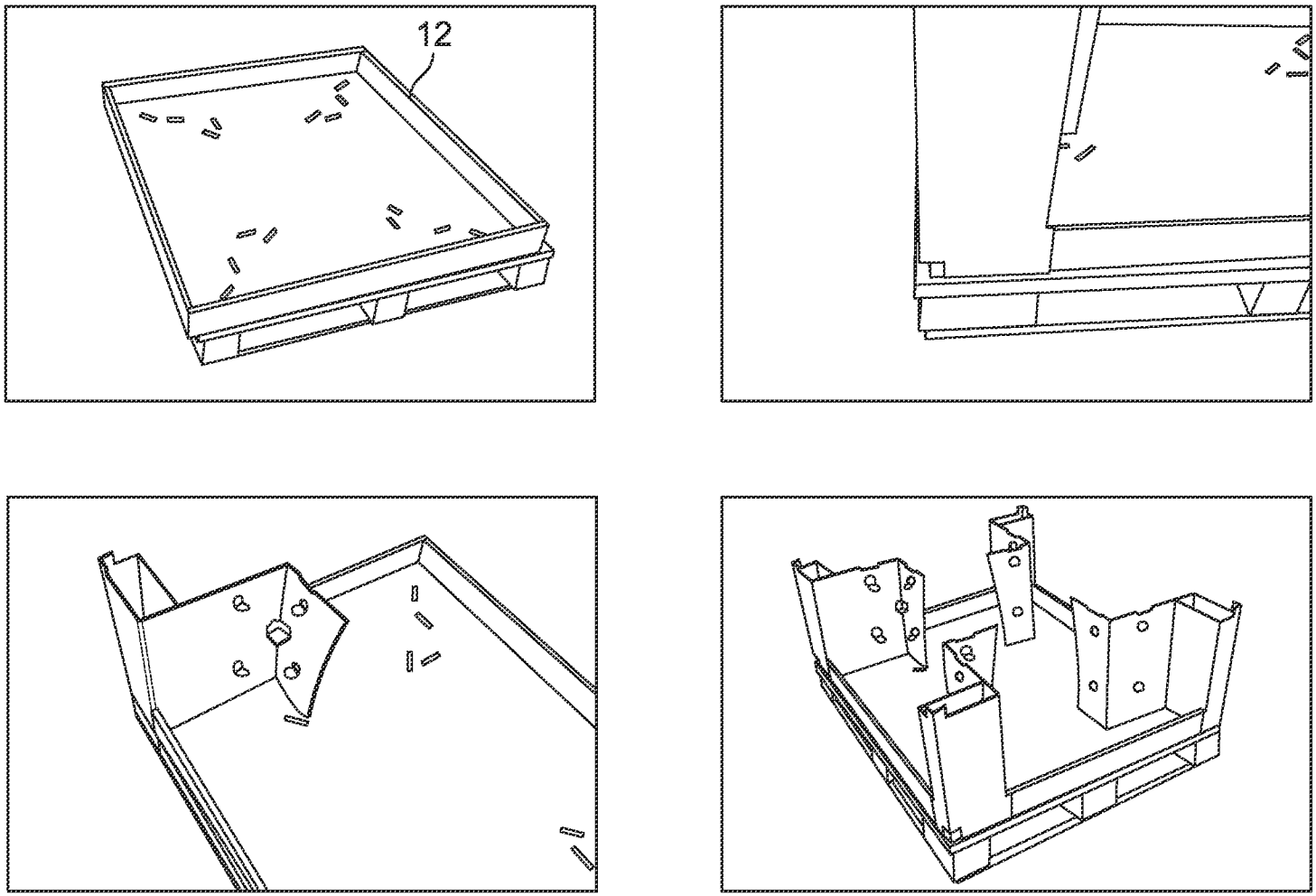
FIGS. 8A-8B are a series of perspective views illustrating partially assembling the pallet assembly of FIG. 1.
Figure 8B:
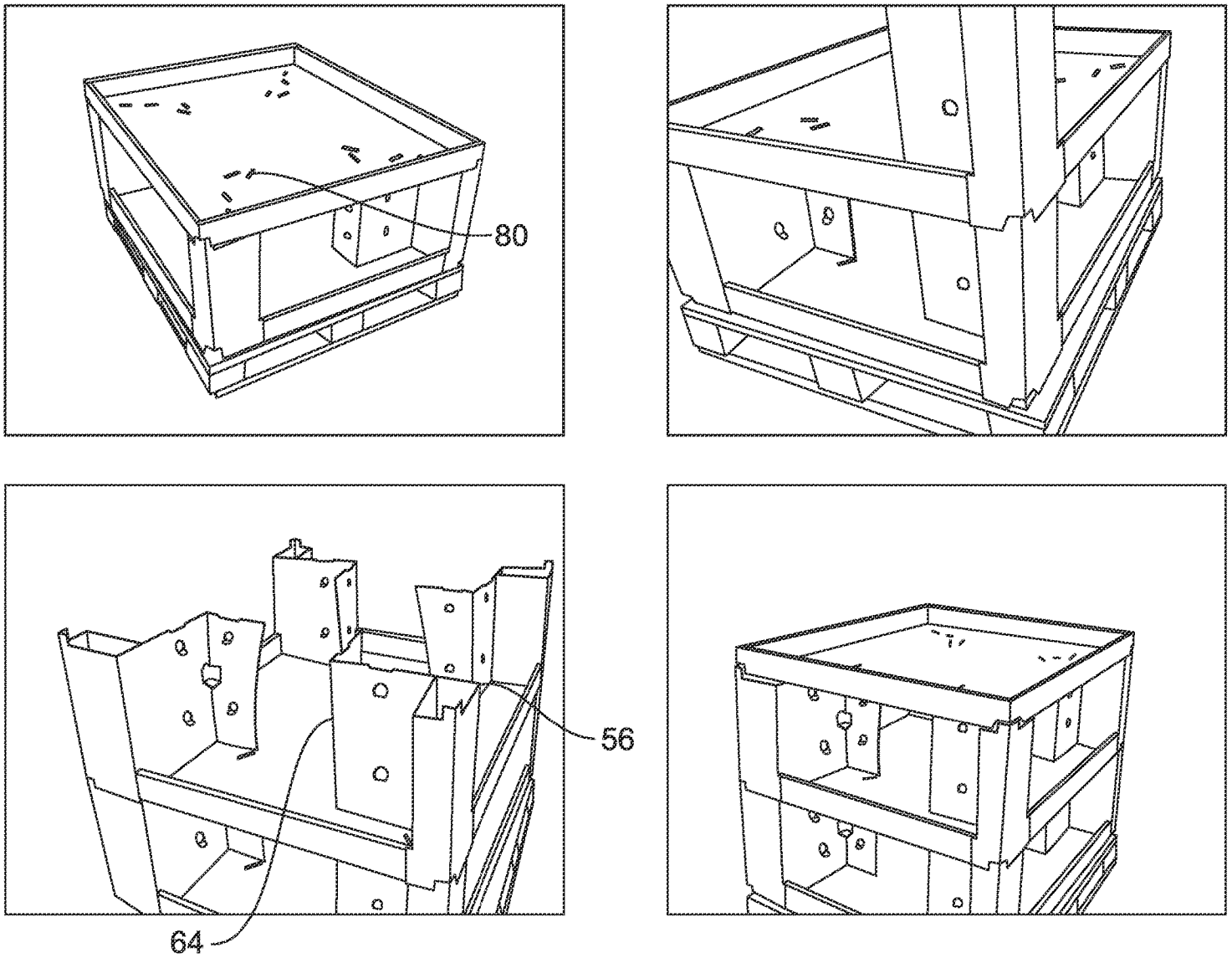
Figure 9A:
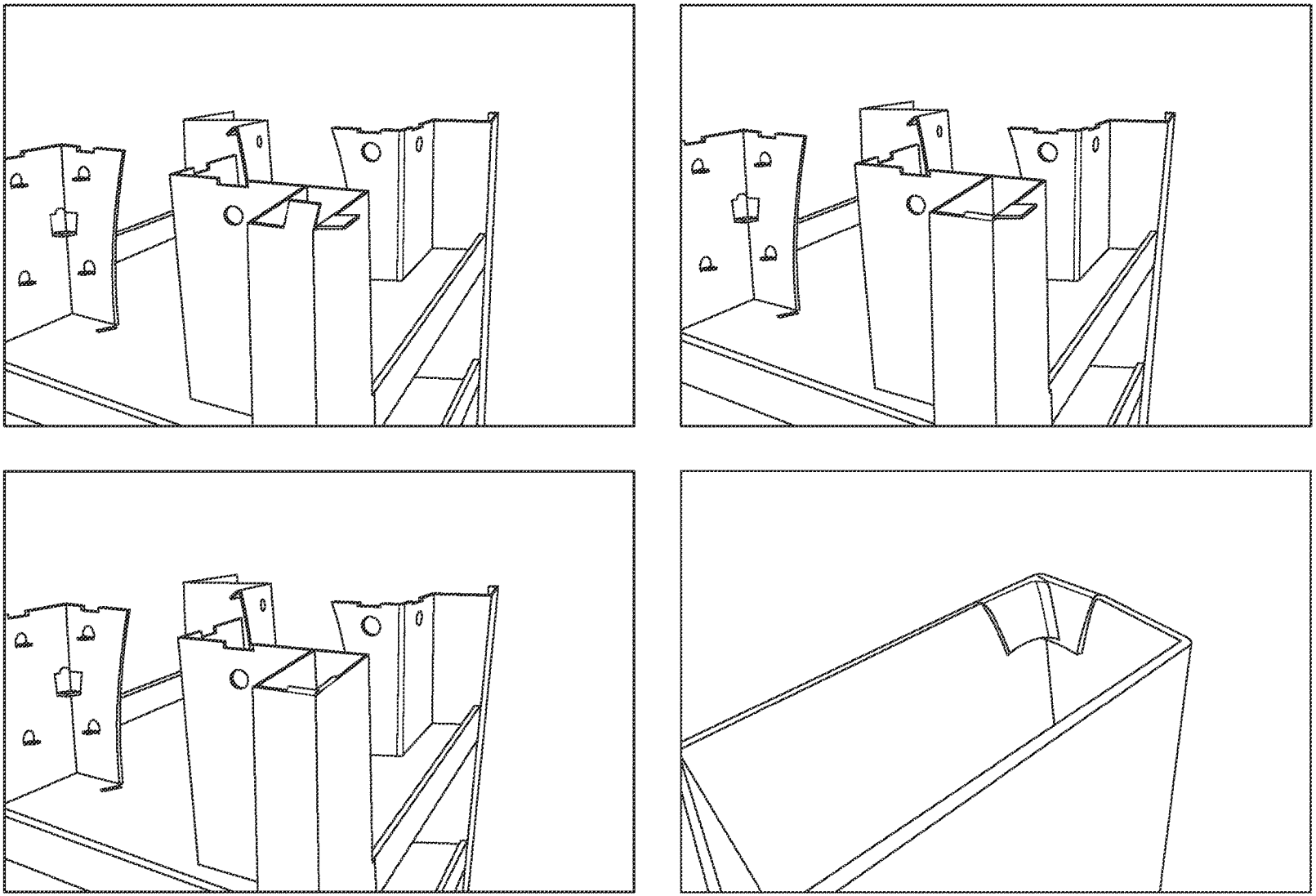
FIGS. 9A-9B are a series of perspective views illustrating completing assembling of the pallet assembly of FIG. 1; and, FIG. 10 is a top view of a pallet assembly of the present invention with product on the assembly.
Figure 9B:
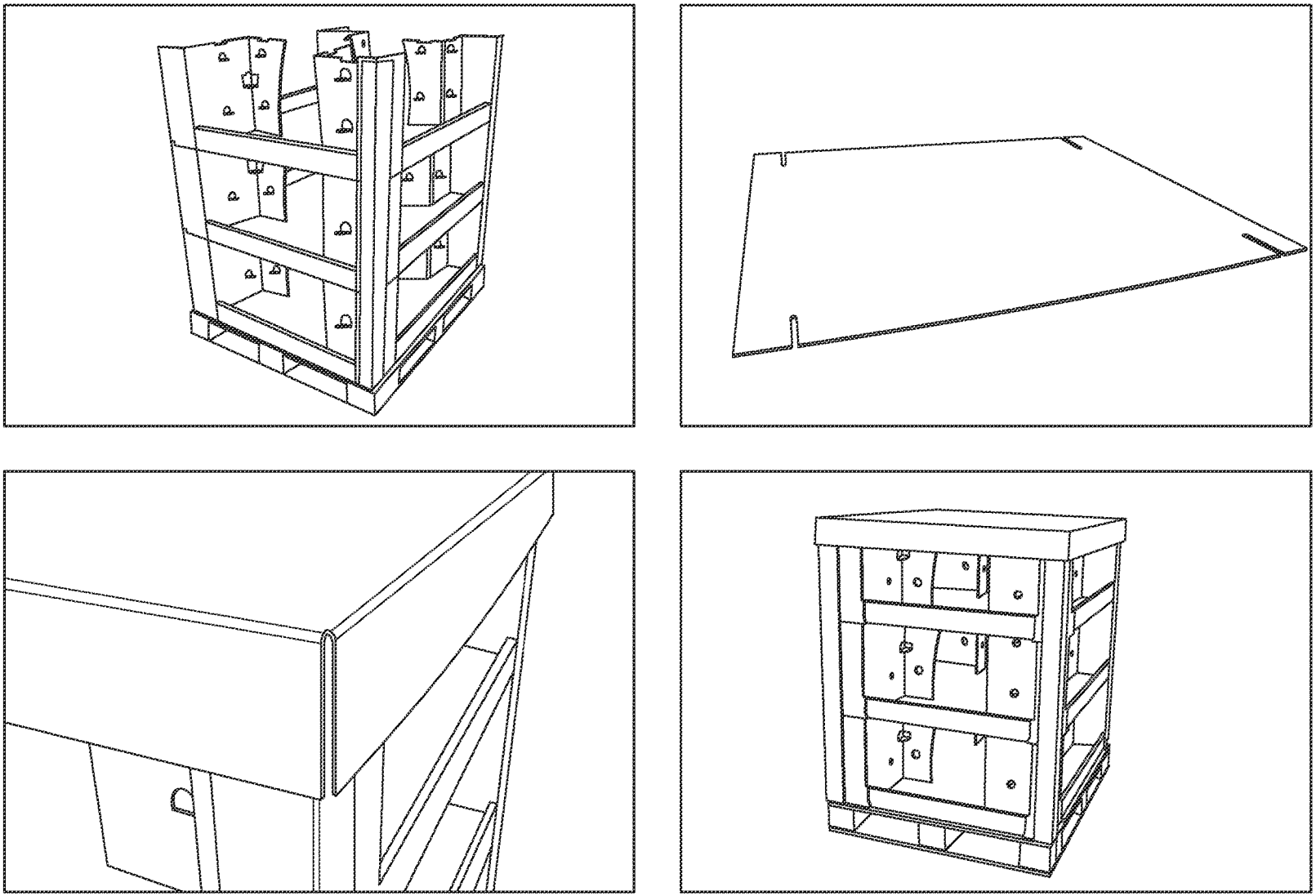

FIG. 7 illustrates forming of a support 20 from the blank 46. The blank 46 is folded to form the rectangular corner portion 56 and the wing portion 64. Locking tabs 72 are used to keep the multiple panels forming the wing portion 64 together. A rectangular tab 74 is utilized to position an end segment 76 of the wing portion 64 at a right angle.

The support 20 includes a plurality of lower tabs 78. The lower tabs 78 cooperate with slots 80 in the support surface 28 of the tray 12, 14 or 16 to facilitate stabilizing and securing the support 20 on the tray.

FIGS. 8A-8B and 9A-9B illustrate construction of the pallet assembly 10 from the component parts (i.e., trays, supports and top cap). Starting with a bottom tray 12, four supports 20 are placed in the four corners of the tray 12. As set forth above, the tabs 78 on the supports 20 are placed in slots 80 on the tray surface 28.

The supports 20 also include partial cut portions 82 that enable a lower corner portion of the support 20 to extend on the outer side wall in the corner of the tray. This lower corner portion also includes a recess 84 configured to mate with the upper tab 86 of a like support from a lower level of the assembly 10. The upper tabs 86 of the topmost level can be folded downward into the interior of the rectangular portion 56 of the support 20 to facilitate placement of the top cap.

The second tray 14 is placed on the four supports 20 on the tray 12 and the process is repeated until a final level (e.g., three) is formed. The top cap 18 is placed on the supports 20 for the uppermost level.

Figure 10:
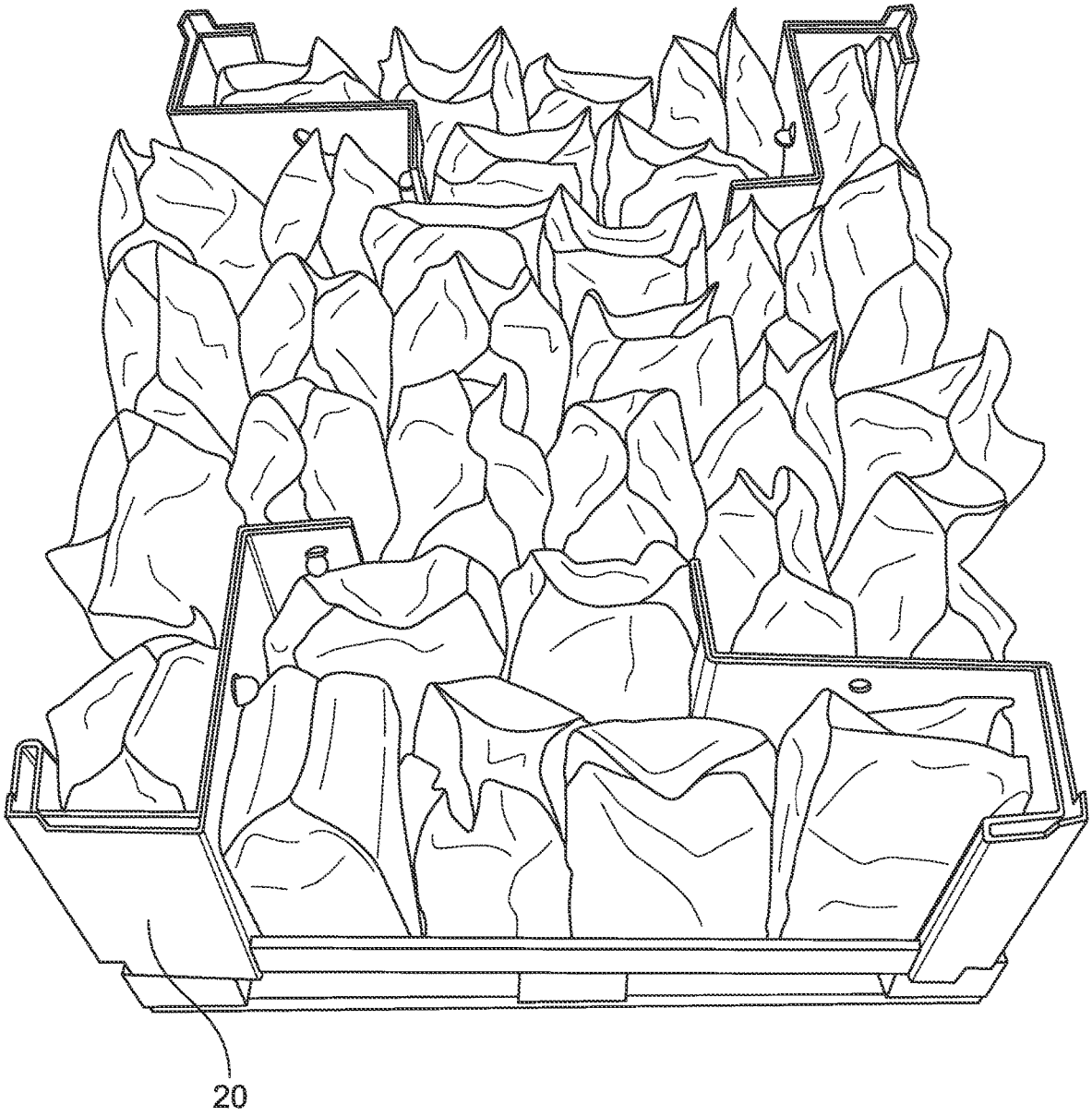

FIG. 3B and FIG. 10 show a modified support 20' formed from blank 46'. Rather than forming a rectangular (in cross-section) portion, the panels of the blank 46' fold back on each other (via a double fold 90) to create an L-shaped, double-walled, corner portion and a wing or divider portion that extends into the interior of the tray. When folded about 90, panel 62 aligns with panel 58 such that the tabs 72 can fold down to interlock the panels together. Rectangular tab 75 can fold into an opening defined by moving tab 77 to secure panel 60 at a right angle to panel 58.

Many modifications and variations of the present invention are possible in light of the above teachings. It is, therefore, to be understood within the scope of the appended claims the invention may be protected otherwise than as specifically described.

We claim:

1. A pallet assembly comprising:

a first tray having a support surface; and, a first support extending upward from the support surface, the first support having a post and a wing extending from the post into an interior portion of the first tray, the wing having a first planar panel and a second planar panel extending at an angle with respect to the first planar panel wherein the first planar panel and the second planar panel act as a divider in the interior portion.

2. The pallet assembly of claim 1 wherein the support surface of the first tray is rectangular.

3. The pallet assembly of claim 2 wherein the post of the first support is formed from a plurality of panels having a rectangular cross-sectional shape.

4. The pallet assembly of claim 2 further comprising a second support extending upward from the support surface, the second support having a post and a wing extending from the post, the wing having a first planar panel and a second planar panel extending at an angle with respect to the first planar panel.

5. The pallet assembly of claim 4 further comprising a third support extending upward from the support surface, the third support having a post and a wing extending from the post, the wing having a first planar panel and a second planar panel extending at an angle with respect to the first planar panel.

6. The pallet assembly of claim 5 further comprising a fourth support extending upward from the support surface, the fourth support having a post and a wing extending from the post, the wing having a first planar panel and a second planar panel extending at an angle with respect to the first planar panel.

7. The pallet assembly of claim 6 wherein each wing of the second support, the third support and the fourth support is formed having a first layer of material and second layer of material.

8. The pallet assembly of claim 2 wherein the tray includes a first side wall, a second side wall, a third side wall and a fourth side wall.

9. The pallet assembly of claim 1 wherein the wing is formed from a first layer of material and a second layer of material.

10. The pallet assembly of claim 9 wherein the wing includes a first locking tab connecting the first layer of material to the second layer of material.

11. The pallet assembly of claim 10 further comprising a second locking tab connecting the first layer of material to the second layer of material, the second locking tab spaced from the first locking tab.

12. A pallet assembly comprising:

a first tray having a support surface; and, a first support extending upward from the support surface, the first support having a post and a wing extending from the post, the wing having a first planar panel and a second planar panel extending at an angle with respect to the first planar panel wherein the wing is formed from a first layer of material and a second layer of material and includes a first locking tab connecting the first layer of material to the second layer of material;

a second locking tab connecting the first layer of material to the second layer of material, the second locking tab spaced from the first locking tab wherein the first locking tab is positioned in the first planar panel of the wing and the second locking tab is positioned in the second planar panel of the wing.

13. The pallet assembly of claim 1 wherein the support surface of the tray includes a plurality of slots.

14. The pallet assembly of claim 13 wherein the wing includes a plurality of tabs extending downward, wherein each tab engages one of the plurality of slots in the support surface.

15. The pallet assembly of claim 1 wherein the tray and post are formed from a corrugated paper.

16. The pallet assembly of claim 1 wherein the post includes a tab extending upward from a top portion of the post.

17. A pallet assembly comprising:

a first tray having a rectangular support surface; and, a first support extending upward from a first corner of the support surface, the first support having a post and a wing extending from the post into an interior portion of the first tray, the wing having a first planar panel and a second planar panel extending at an angle with respect to the first planar panel wherein the first planar panel and second planar panel act as divider in the interior portion;

a second support extending upward from a second corner of the support surface, the second support having a post and a wing extending from the post into the interior portion of the first tray, the wing having a first planar panel and a second planar panel extending at an angle with respect to the first planar panel wherein the first planar panel and second planar panel act as divider in the interior portion;

a third support extending upward from a third corner of the support surface, the third support having a post and a wing extending from the post into the interior portion of the first tray, the wing having a first planar panel and a second planar panel extending at an angle with respect to the first planar panel wherein the first planar panel and second planar panel act as divider in the interior portion; and, a fourth support extending upward from a fourth corner of the support surface, the fourth support having a post and a wing extending from the post into the interior portion of the first tray, the wing having a first planar panel and a second planar panel extending at an angle with respect to the first planar panel wherein the first planar panel and second planar panel act as divider in the interior portion.

18. The pallet assembly of claim 17 wherein each wing of the first support, second support, third support and fourth support is formed having a first layer of material and a second layer of material.

19. The pallet assembly of claim 18 wherein each wing of the first support, second support, third support and fourth support includes a locking tab connecting the first layer of material to the second layer of material.

20. The pallet assembly of claim 17 wherein the tray and the first, second, third and fourth supports are formed from a corrugated paper.

* * * * *